US006407646B1

(12) United States Patent
Johnson

(10) Patent No.: US 6,407,646 B1
(45) Date of Patent: Jun. 18, 2002

(54) DISTRIBUTED THREE PORT STACKED WAVEGUIDE CIRCULATOR

(76) Inventor: Ray M. Johnson, 22661 Highway 62, Shady Cove, OR (US) 97539

( * ) Notice: Subject to any disclaimer, the term of this patent is extended or adjusted under 35 U.S.C. 154(b) by 0 days.

(21) Appl. No.: 09/534,908

(22) Filed: Mar. 23, 2000

(51) Int. Cl.[7] ..... H01P 1/39

(52) U.S. Cl. ..... 333/1.1; 333/24.2
(58) Field of Search ..... 333/1.1, 24.1, 333/24.2, 158

(56) References Cited

U.S. PATENT DOCUMENTS

| | | | | | |
|---|---|---|---|---|---|
| 3,041,554 | A | * | 6/1962 | Blasburg et al. | 333/24.2 |
| 3,201,715 | A | * | 8/1965 | Breese | 333/1.1 |
| 3,212,028 | A | * | 10/1965 | Wantuch | 333/1.1 |
| 3,214,711 | A | * | 10/1965 | Lyon et al. | 333/24.1 |
| 4,058,780 | A | | 11/1977 | Riblet | 333/1.1 |
| 4,286,135 | A | * | 8/1981 | Green et al. | 333/24.1 X |
| 4,374,367 | A | * | 2/1983 | Foreterre | 333/241.1 |
| 4,801,902 | A | | 1/1989 | Hoover et al. | 333/1.1 |

FOREIGN PATENT DOCUMENTS

| | | | | |
|---|---|---|---|---|
| JP | 60-232701 | * | 11/1985 | 333/24.1 |

OTHER PUBLICATIONS

Robert E. Collin, foundations for Microwave Engineering, McGraw–Hill, Intro and pp. 304–309, 1965.

J. Helszajn, Passive and Active Microwave Circuits, John Wiley & Sons, 1978, pp. 139–145.

* cited by examiner

*Primary Examiner*—Justin P. Bettendorf
(74) *Attorney, Agent, or Firm*—Donald L. Beeson

(57) ABSTRACT

A three port distributed waveguide circulator has a hybrid coupler section connected to a waveguide section which is bifurcated by a central web plate to produce reduced height stacked waveguides and which is loaded with a distributed non-reciprocal ferromagnetic material for producing relative phase shifting of the microwave power traveling through the reduced height guides. In one embodiment, the coupler output is stepped down to the reduced height waveguides by a stepped transformer between the output of the hybrid coupler and the bifurcated input end of the bifurcated waveguide section. Alternatively, a tapered transformer is provided. A static magnetic circuit is provided for producing transverse static magnetic fields in the reduced height waveguides necessary for the distributed ferromagnetic material to exhibit non-reciprocal properties. The ferromagnetic material in the reduced height waveguides of the bifurcated waveguide is preferably in the form of ferromagnetic strips which are secured to the outer broadwalls of the bifurcated guides and which are cooled by cooling tubes running along the outside of the broadwalls.

35 Claims, 5 Drawing Sheets

DISTRIBUTED THREE PORT STACKED WAVEGUIDE CIRCULATOR

BACKGROUND OF THE INVENTION

The present invention generally relates to high power waveguide systems, and more particularly to waveguide circulators having several terminals or ports so arranged that microwave energy entering one port is transmitted to the next adjacent port in a defined manner.

Microwave circulators are well-known non-reciprocal microwave devices used in a variety of applications, including isolating a microwave power source from a reflective microwave load. By inserting a circulator between the microwave source and microwave load, the source can be isolated from the load without absorbing a significant portion of the generated power. For example, most conventional circulators provide isolation with insertion loss from about 3.5 to 5 percent of generated power, leaving 95 to 96.5 percent of the available power for the intended application. Typically, a microwave power source will be either a self-excited magnetron oscillator or a klystron amplifier. The magnetron oscillator is a less costly source of microwave power and can be used in lower power applications. However, both the power and frequency output of the magnetron is influenced by the magnitude and phase of the power reflected from the load, and can be damaged if load reflections are too large. Klystrons, on the other hand, are less sensitive to load reflections, but nonetheless can experience damage if such reflections are excessive.

Two types of waveguide circulators have heretofore been used to protect microwave sources. One is a three port waveguide junction circulator which is typically used for lower power applications, and another is a four port (phase shift) circulator which is used for higher power applications. Generally, the four port phase shift circulator design provides greater isolation and higher power handling capability than three port circulators, however, four port circulators are more expensive and have more demanding physical requirements due to the additional port of the circulator. The three port circulator, provides a less costly and physically less demanding alternative to the four port circulator.

The most general form of a three port junction circulator consists of a symmetrical distribution of a non-reciprocal ferromagnetic material at the junction of three waveguide transmission lines. In a usual configuration, an H-Plane waveguide T forms a junction where two thin ferrite discs are supported on two short posts protruding from the opposite broadwalls of the waveguide junction. The ferrite disks are magnetized in a direction that is perpendicular to the plane of the disks by a static magnetic field produced by a C-shaped magnet surrounding the junction. The non-reciprocal ferrite disks produce a rotation in the microwave energy at the junction of the waveguide T.

Despite its cost advantages, the three port junction circulator has a number of disadvantages. These disadvantages include limited power handling capabilities. This limitation is largely due to the field strengths generated in the gap between the relatively small disks and the difficulty of cooling the disks which generate increasing amount of heat with increased power levels. Further disadvantages include limited frequency bandwidth and sensitivity to temperature changes which, among other things, can be affected by changes in the temperature of the water coolant passed through the circulator. To overcome these disadvantages, efforts have been made to improve the heat transfer characteristics of the ferrite disks and to reduce the ferrite heating and E field breakdown in the gap by adding additional disks to a bifurcating septum between the posts on which the ferrite disks are supported. However, despite these efforts, power handling capabilities of conventional three port circulators have had difficulty keeping up with the increased power availability from microwave sources. Nor have improvements in these three port junction circulators overcome the frequency bandwidth or temperature sensitivity limitations inherent in these devices.

The present invention provides a three port circulator design which provides the benefits of a four port circulator—increased power handling capability and frequency bandwidth and decreased temperature sensitivity—while maintaining the advantages of a conventional three port circulator, namely, cost advantages and reduced physical requirements. The distributed three port circulator of the present invention is particularly adapted for high power microwave systems such as resonant cavity electron accelerators which require isolation to protect and stabilize the microwave power source .

SUMMARY OF THE INVENTION

Briefly, the present invention involves a distributed three port waveguide circulator which includes a waveguide coupler section which preferably is a 3 db (hybrid) waveguide coupler, and a stacked waveguide section having dual waveguide paths, at least one of which is loaded with a distributed non-reciprocal ferromagnetic material for producing a phase shift in the microwave power traveling in one waveguide path relative to power traveling in the other. In the preferred embodiment of the invention, the waveguide sizes in the waveguide coupler section are full height guides and the dual waveguide paths in the stacked waveguide section are reduced height guides which combine at a stacked output end of the guides at full height. A transformer section, suitably a stepped waveguide transformer, is provided to couple the full height guides of the waveguide coupler section to the reduced height guides of the stacked waveguide section.

More particularly, the waveguide coupler section is comprised of a first waveguide path having defined terminals A and B, a second waveguide path having defined terminals C and D, and an apertured common wall portion for dividing power introduced to any one of the terminals A, B, C or D between the first and second waveguide path. The apertured common wall portion produces a ninety degree phase shift in the power coupled from one to the other of the waveguide paths such that the divided microwave power delivered to the coupler output at terminals B and C are ninety degrees out of phase. The divided microwave power will enter the two waveguide paths of the stacked waveguide section with this same phase relationship.

In its preferred design, the stacked waveguide section is a bifurcated waveguide section comprised of a section of waveguide corresponding in cross-sectional size and shape to the first and second waveguide portions of the waveguide coupler section. This section of waveguide is bifurcated into two stacked, approximately one-half height waveguides to provide dual reduced height waveguide paths through the bifurcated section. The bifurcated waveguide section has a bifurcated input end for receiving and transmitting divided power from and to the coupler output of the waveguide coupler section, and a bifurcated output end for delivering combined power from the dual waveguide paths of the bifurcated guide. At least one, and preferably both, of the reduced height waveguides of the bifurcated guide are loaded with distributed strips of a non-reciprocal ferromagnetic material such as ferrite or garnet (sometimes herein referred to as simply "ferrite") extending along at least a portion of its length such that, when the ferromagnetic strips are properly magnetized in the presence of transverse static magnetic field, they act to produce a phase shift in the microwave power traveling through one of the reduced height waveguides relative to the other reduced height waveguide. A magnetic circuit, such as an arrangement of permanent magnets and pole plates, is provided in association with the bifurcated waveguide section for magnetizing the distributed ferromagnetic material. The ferrite loaded portion of the bifurcated waveguide section is of sufficient length to permit differential phase shifting of the power received by the stacked guides at the bifurcated input end of the bifurcated waveguide section to arrive substantially in phase at the section's bifurcated output end to thereby permit the combined power from the dual waveguide paths of the bifurcated guide to be delivered to a microwave load. Conversely, the non-reciprocal property of the ferrite loaded portion of the bifurcated waveguide section will cause power traveling through the bifurcated guide which is reflected from the microwave load to experience differential phase shifting that is the reverse of the differential phase shift experienced by power traveling in the opposite direction to the load. Thus, reflected power arrives at the output end of the waveguide coupler from the bifurcated waveguide section in an out-of-phase relationship that is the reverse of the out-of-phase relationship of power fed from the coupler output to the bifurcated guide. This, in turn, permits the splitting and sebsequent summation of the reflected power within the waveguide coupler in a manner that directs the reflected power to the desired waveguide path of the waveguide coupler.

In the preferred embodiment, the reduced height waveguides of the bifurcated waveguide section are rectangular waveguides separated by a common web plate fabricated of a magnetic material, such as steel, which is plated with a conductive material such as copper or silver. This web plate forms an inner waveguide broadwall opposite the ferromagnetic strips and is a part of the magnetic circuit for producing a static magnetic field in the reduced height guides.

In a further aspect of the invention, means for cooling the ferromagnetic strips attached to the outer broadwalls of the bifurcated waveguide section are provided in the form of cooling tubes extending along the outside surface of the outer broadwalls of the reduced height waveguides in a position that is close to the ferromagnetic strips on the reverse sides of the broadwalls.

In still a further aspect of the invention, a method is provided for isolating a microwave power source from a microwave load. The method includes the step of introducing power from the microwave source to a first waveguide path of a waveguide coupler which divides the power into two first and second waveguide paths such that the divided power is approximately ninety degrees out-of-phase. The waveguide coupler also causes reflected power arriving at the coupler output to cancel in the first waveguide path and add in the second waveguide path. A further step of the method involves passing the divided out-of-phase power from the coupler output through stacked downstream waveguide paths having a stacked waveguide output. At least one and preferably both of the stacked waveguide paths are loaded with a lengthwise distributed non-reciprocal ferromagnetic material which causes the power traveling down one of the stacked waveguide paths to be phase shifted approximately ninety degrees relative to the power in the other stacked waveguide path such that power in both waveguide paths arrive at the stacked waveguide output substantially in phase, whereupon the microwave power is delivered to a useful microwave device or load connected to the stacked waveguide output. The ferrite loading of the dual downstream waveguide paths further causes power reflected back through the dual waveguide paths to be differentially phase shifted in reverse such that it arrives at the coupler output in the proper out-of-phase relationship that permits reflected power divided and summed in the coupler section to cancel in the first waveguide path of the coupler but add in the second waveguide path. A microwave power source connected to a first port of the circulator associated with this the first path will be isolated from the microwave load connected to a second port of the circulator at the stacked waveguide output of the stacked downstream waveguide paths when a well matched microwave load for absorbing reflected power is connected to a third port of the circulator associated with the second microwave path of the waveguide coupler.

Due to the use of a distributed ferromagnetic material in the three port waveguide circulator and method of the present invention, the heated ferromagnetic material will be easier to cool and will be capable of handling higher power levels as compared to conventional three port junction circulators. The distributed ferromagnetic material also will provide for greater bandwidth capabilities and decreased temperature sensitivity. The foregoing objectives are additionally achieved in a waveguide circulator construction that is generally less costly than four port waveguide circulators conventionally used in high power applications. Other objects and advantages of the invention will be apparent from the following specification and claims.

DETAILED DESCRIPTION OF THE ILLUSTRATED EMBODIMENT

Figure 1:
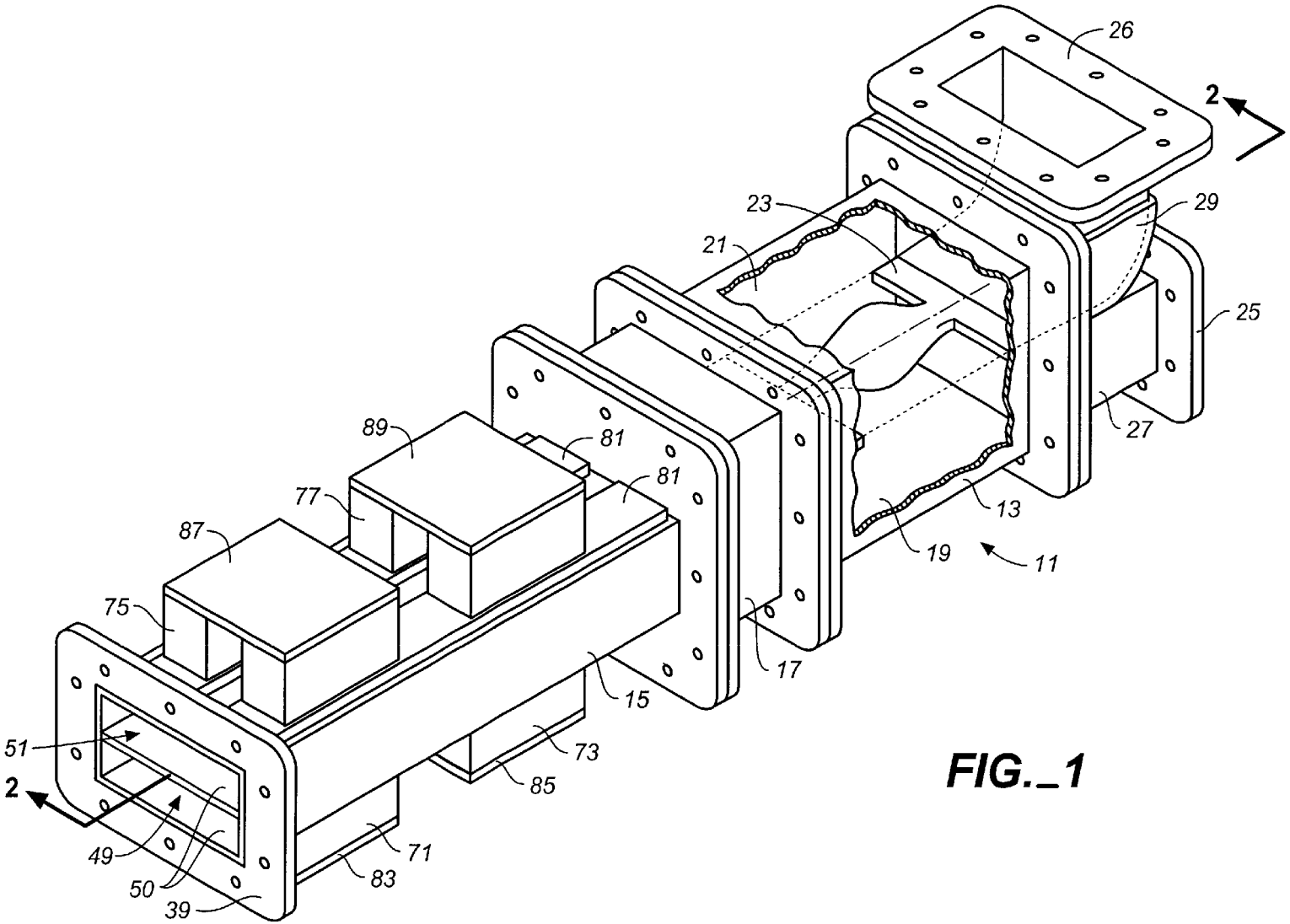
FIG. 1 is a top perspective view of a distributed three port circulator in accordance with the invention, with the waveguide coupler section of the circulator shown in a cut-away view to show the apertured common wall portion thereof.

Referring now to the drawings, FIGS. 1, 2, 2A, 4 and 5 disclose a first embodiment of the invention wherein the distributed three port waveguide circulator 11 has an input waveguide coupler section 13, an elongated bifurcated waveguide section 15 and a separate transformer section 17 for, as hereinafter described, coupling the coupler output 18 of the waveguide coupler section to the bifurcated waveguide section. In FIG. 3, the distributed three port waveguide circulator 11*a* is similar to the waveguide circulator 11 shown in the other figures except the transformer portion of the circulator is not a separate component, but is integrated into the waveguide coupler section. In both illustrated embodiments the construction of the bifurcated waveguide section of the circulator is substantially the same.

Referring now to the embodiment shown in FIGS. 1, 2, 2A, 4 and 5, waveguide circulator 11 is seen to have three ports, identified as port 1, port 2, and port 3. In a typical application, a microwave power source (not shown) is attached to port I for introducing microwave power into the waveguide coupler section 13 at the front end of the circulator. As above-mentioned this power source would suitably be a klystron or magnetron for high power applications. The microwave power introduced at this port is propagated through the circulator as hereinafter described until it arrives at port 2 of the circulator which, again in a typical application, delivers the microwave power to a microwave load such as a linear accelerator (not shown). Reflected power from the microwave load is in turn propagated back through the circulator and emerges from port 3. A well matched power absorbing waveguide termination (not shown), such as a water load designed as described in U.S. Pat. No. 4,516,088, is attached to port 3 to absorb the reflected power . In this manner, the microwave source attached to port 1 of the circulator is isolated from the microwave load fed from port 2.

The input waveguide coupler section 13 of the three port circulator is preferably a three db (hybrid) top wall waveguide coupler having first full height rectangular waveguide portion 19 providing a first waveguide path, a second full height waveguide rectangular portion 21 providing a second waveguide path, an apertured common wall portion 23 for coupling the first waveguide path to the second waveguide path, and defined terminals A, B, C and D defining the ends of the waveguide paths. In accordance with the well-known theory of waveguide couplers, the portion removed from the apertured common wall of the coupler is removed around a plane of symmetry running the length of the adjacent waveguide paths of the coupler to permit coupling between the two waveguide paths such that divided power traveling along one of the waveguide paths is ninety degrees out-of-phase relative to power traveling in the other guide. In a hybrid (3 db) coupler power divides substantially equally between the two waveguides. More specifically, power inputted at terminal A of hybrid coupler 13 will be divided equally between the two output terminals B and C forming coupler output 18 where the two components of the power from port 1 will be phase shifted by ninety degrees. It can be seen that port 1 of the circulator is associated with terminal A of the hybrid coupler and port 3 with terminal D. Ports 1 and 3 and their associated waveguide flanges 25, 26 are located at the end of short connecting rectangular waveguide sections 27, 29 secured to a large common waveguide flange 31 which can be mounted to a similarly sized flange 33 at the front end of the hybrid coupler. The short connecting waveguide section 29 associated with port 3 is curved upward to accommodate the hardware of the waveguide system connected to ports 1 and 3.

Figure 2:
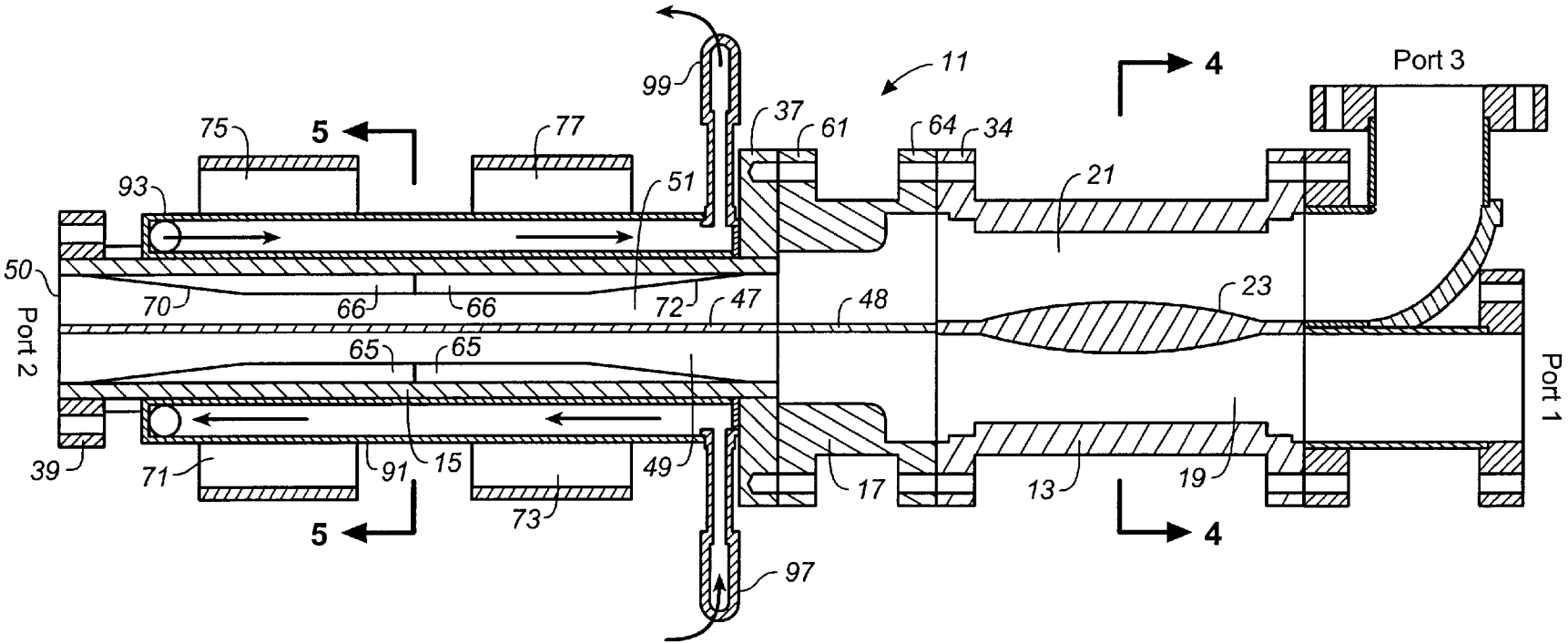
FIG. 2 is a cross-sectional view in side elevation of the distributed three port waveguide circulator shown in FIG. 1 taken along lines 2—2.
Figure 2A:
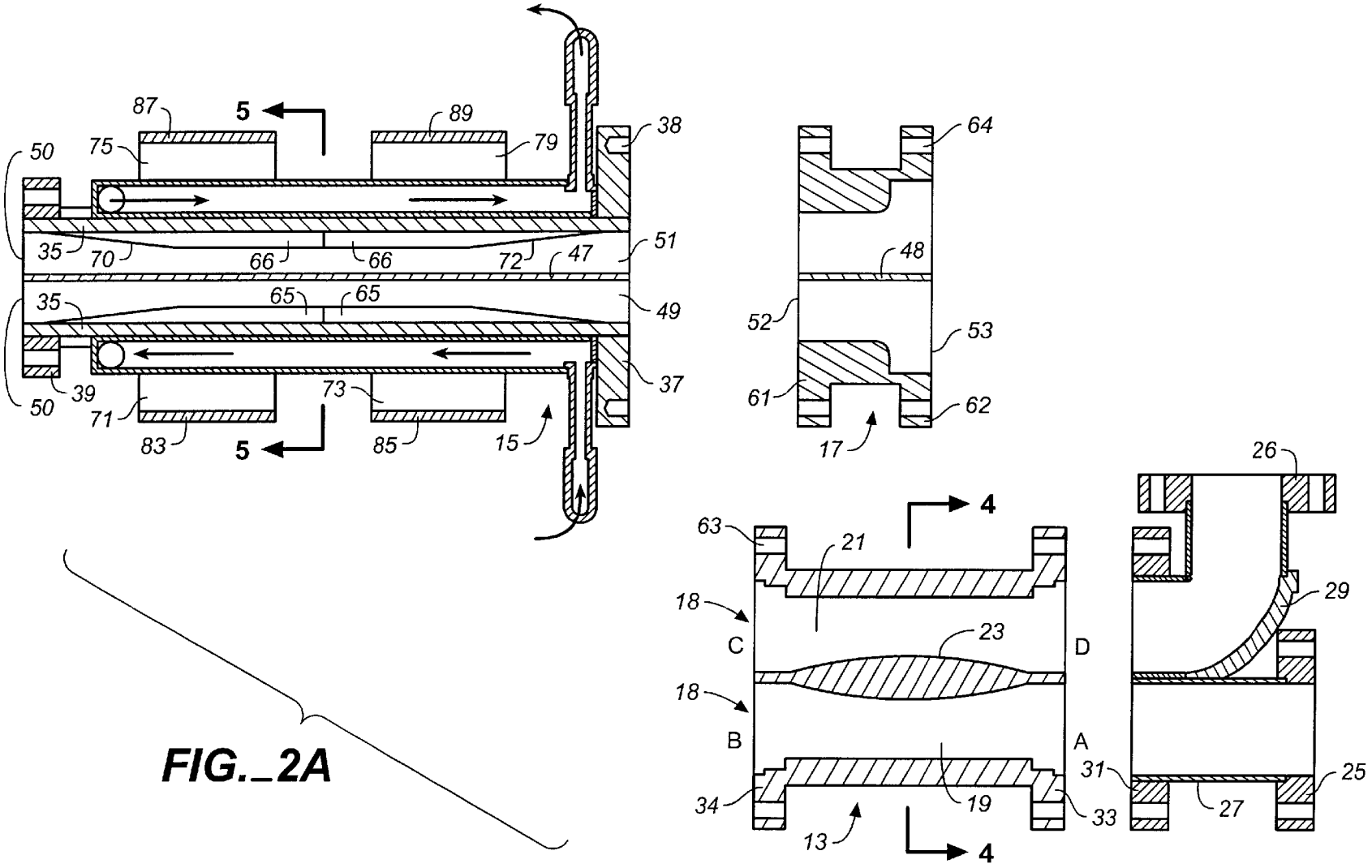
FIG. 2A is an exploded cross-sectional view thereof taken.
Figure 3:
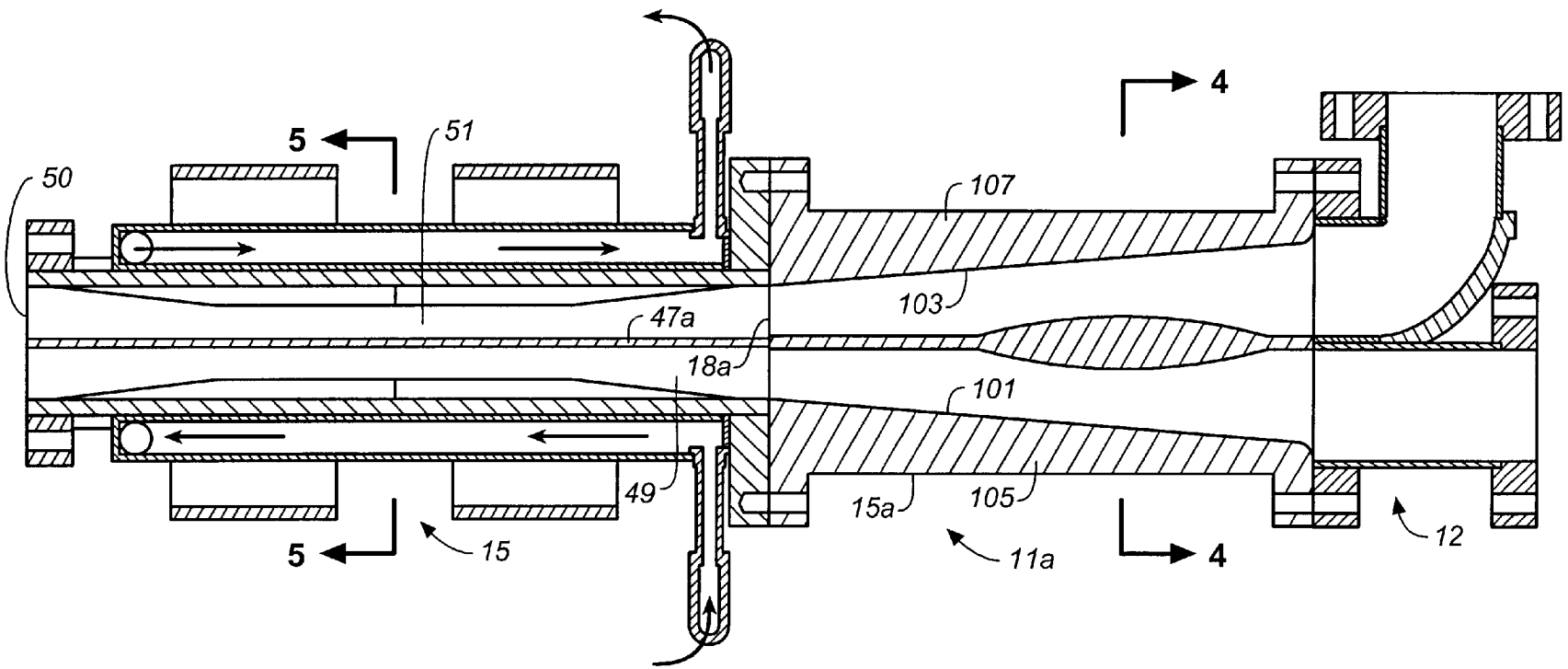
FIG. 3 is a cross-sectional view inside elevational of an alternative embodiment of the distributed three port circulator shown in FIG. 1 wherein the transformer portion of the waveguide coupler is integrated into the waveguide coupler section of the circulator.
Figure 4:
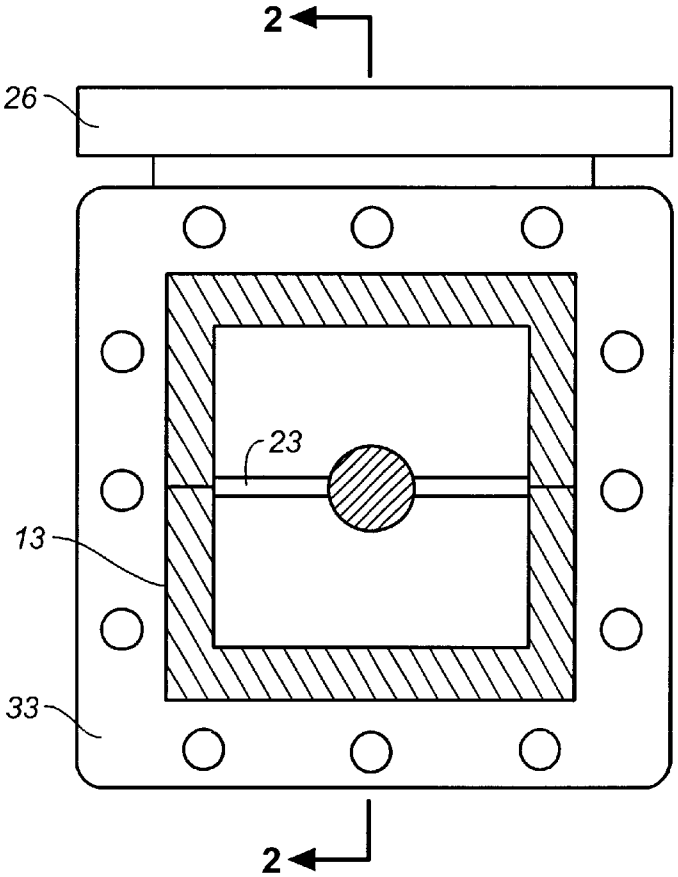
FIG. 4 is a cross-sectional view of the waveguide coupler section of the distributed three port waveguide circulator shown in FIG. 2A taken along lines 4—4.
Figure 5:
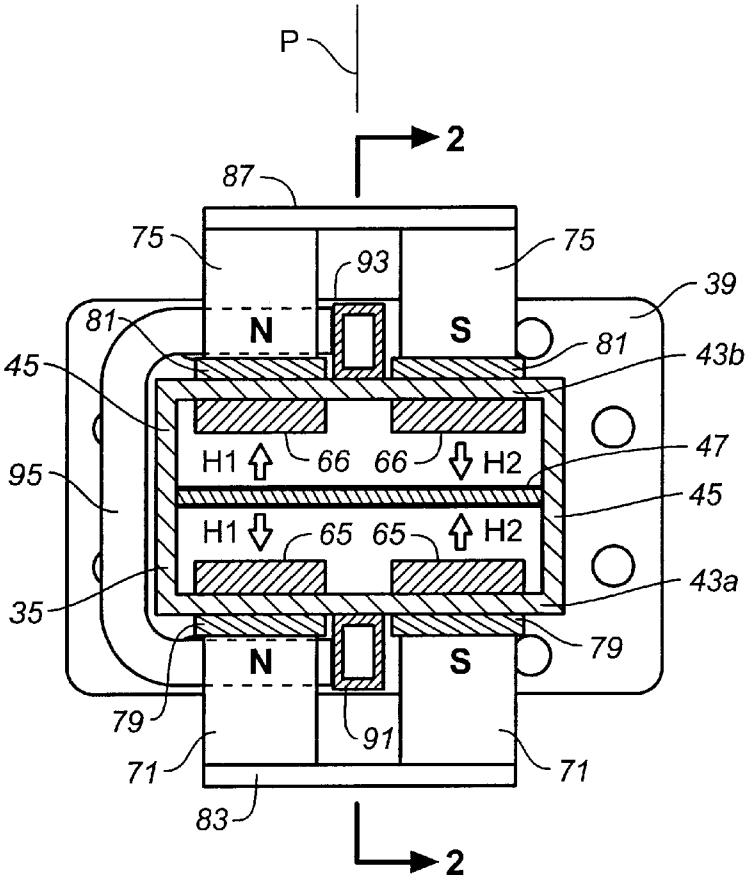
FIG. 5 is a cross-sectional view of the distributed three port waveguide circulator shown in FIG. 2A taken along lines 5—5.

Referring to FIGS. 2 and 5, it can be seen that the bifurcated waveguide section 15 of waveguide circulator 11 includes an elongated section of waveguide 35 terminated at its interior end by waveguide flange 37, and at its output end 50 by waveguide flange 39. It can also be seen that the outer waveguide flange 39 defines port 2 of the circulator. In the illustrated embodiment, the waveguide section 35 is a standard size full height rectangular waveguide which corresponds in size to the first and second full height rectangular waveguide portions 19, 21 of the waveguide coupler section 13. As seen in FIG. 5, this section of rectangular guide has lower and upper outer broadwalls 43*a*, 43*b*, and sidewalls 45 and is bifurcated by a longitudinally extending center web plate 47 conductively bonded to the side walls. The web plate runs parallel to the broadwalls and divides the waveguide section 35 into stacked reduced height waveguides 49, 51, which provide dual reduced height waveguide paths downstream of the waveguide coupler. The height of each of these stacked reduced height guides is approximately one-half the full height guide size for the bifurcated section (one half the full guide height less one half the thickness of the web plate), and thus, approximately one-half height the guide height for each of the waveguide paths 19, 21 of the circulator's coupler section 13.

The transformer section 17 is shown as a single step transformer but could as well be a multiple step transformer (or even a tapered transformer such as later described). This section is interposed between the waveguide coupler section and the bifurcated waveguide section provides a means for stepping down from the full height guides into the half height guides with minimal power reflection. More specifically, the full height end 53 of transformer section 17 is connected to the coupler output 18 by means of waveguide flanges 34, 62. At the other end of the transformer section, the reduced height transformer end 57 is connected to the bifurcated input end 59 of the bifurcated waveguide section by means of flanges 37, 61. As is in any conventional waveguide system, the waveguide flanges are secured together by suitably sized flange bolts (not shown) inserted through the flange bolt holes, such as bolt holes 63, 64 of mating flanges 34, 62 of the waveguide coupler and transformer sections. It is noted that the bolt holes 38 in flange 37 at the input end of the bifurcated waveguide section can be suitably threaded to eliminate the need for nuts at the back of the flange, thereby providing more room to accommodate the steel pole plates and water cooling lines hereinafter described.

As best shown in FIG. 2, it can be seen that a separate web plate 48 in the transformer section bifurcates the transformer section into two waveguide paths corresponding to the first and second waveguide paths 19, 21 of the coupler section. The transformer's web plate 48 abuts the web plate 47 of the bifurcated guide to maintain continuous and separate waveguide paths through the circulator.

It can therefore be seen that two parallel waveguide paths are provided through the circulator, one path extending from port 1 to port 2 comprised of the first or lower waveguide portion 19 of the waveguide coupler 13 and the lower reduced height waveguide 49 of the bifurcated waveguide section, and the other comprised of the second or top waveguide portion 21 of the waveguide coupler and the top reduced height waveguide 51 of the bifurcated guide. As hereinafter described, differential and non-reciprocal phase shifting is provided in these waveguide paths by the circulator's bifurcated waveguide section 15. Due to these properties of the bifurcated guide the divided out-of-phase-phase power available from the waveguide coupler output 18 is delivered to the microwave load at port 2 via the two waveguide paths, while power reflected back through the bifurcated guide arrives at the waveguide coupler 13 in the phase relationship required to allow the waveguide coupler to direct or "circulate" the reflected power to the matched waveguide termination at port 3 of the circulator.

Referring again to FIGS. 2 and 5, each of the reduced height waveguides 49, 51 of the bifurcated waveguide section is loaded with a non-reciprocal ferromagnetic material in the form of ferromagnetic strips 65, 66 attached, such as with suitably bonding material, to inner conductive surfaces 67, 69 of the guide's outer broadwall 43*a*, 43*b*. In each of the reduced height guides, the ferromagnetic strips are arranged in pairs positioned symmetrically about the guide's vertical center plane P. Placement of the ferromagnetic strips relative to the center plane P will affect the degree of phase shift achieved in the bifurcated waveguide section, and it is found that greater phase shift can be achieved by placing the ferromagnetic strips slightly closer to the guide's sidewalls 45 than to the center plane. The ferromagnetic strips should be fabricated of a non-reciprocal ferromagnetic material, for example, nickel ferrite or garnet, which is suitable for the power and frequencies involved.

To achieve the desired non-reciprocal phase shift properties of the ferromagnetic strips, a static magnetic field is provided in the reduced height waveguides by means of a magnetic circuit associated with the bifurcated waveguide section which produces oppositely directed magnetic fields through the ferromagnetic strips as generally shown by magnetic field direction arrows H1 and H2 shown in FIG. 5. The magnetic circuit, includes two pairs of U type bar magnets 71, 73 on the bottom of the bifurcated guide 15 and two pairs of permanent bar magnets 75, 77 on the top of the guide. The bar magnet pairs on the bottom of the guide are placed on two elongated pole plates 79 which longitudinally extend in parallel relation along the bottom broadwall 43*a* of the bifurcated waveguide; similarly the permanent U type magnet pairs 75, 77 are positioned in spaced relation along parallel steel pole plate pairs 81 extending longitudinally along the waveguide's top broadwall 43*b*. Each of the permanent U magnet pairs 71, 73, 75, 77 additionally include a bridge plate 83, 85 87, 89 which span and provide a magnetic flux path between the permanent magnets of each permanent U magnet pair. The assembly of the permanent magnets, pole plates, and bridge plates can be secured and positioned on the bifurcated waveguide section by mechanical means (not shown), such as non magnetic metal straps wrapped circumferentially around the assemblies or non magnetic plates secured longitudinally across the tops of the assemblies between the guide's waveguide flanges 37, 39 using suitable brackets, or by adhesive means alone or in combination with mechanical means.

Referring to FIG. 5, it can be seen that the static magnetic circuit additionally includes the central web plate 47 which bifurcates the section of waveguide 41 into upper and lower reduced height waveguides 49, 51. To provide a path for the static, magnetic flux as well as low surface conductivity for the microwave power traveling through the reduced height guides, the center web plate is suitably fabricated of steel which is copper or silver plated to provide a suitable conductive surface. In a WR284 waveguide size, the copper plated steel web plate can suitably have a thickness of approximately 0.0005 inch.

With further reference to FIG. 5, it can be seen that the permanent magnets of the magnet pairs 71, 73, 75, 77, are arranged such that opposite poles of the permanent magnets are placed against opposite longitudinal pole plates 79, 81 extending along the guide's broadwalls 43*a*, 43*b*. It can further be seen that the pole plates extend along the guide's broadwalls opposite the ferromagnetic strips inside the guide. These elongated pole plates act to distribute the static magnetic field and to thereby provide the desired static transverse magnetic field through the entire length of the ferromagnetic strips.

In the ideal design, the magnetic field as shown by field arrows H1 and H2 in FIG. 5 are oriented in a perfectly transverse direction between web plate 47 and plates 79, 81 to provide perfectly transverse static fields that are perfectly orthogonal to the broad dimension of the ferromagnetic strips. However, in reality, some fringing will occur toward the inside edges of the ferromagnetic strips and pole plates. Such fringing effects can be reduced by maintaining adequate separation between the ferromagnetic strips to either side of the guide center. Referring to FIG. 2, it is additionally noted that ferromagnetic strips 65, 66 have tapered ends 70, 72 to provide microwave matching from the two ends of the bifurcated guide.

With further reference to FIG. 2, the distributed magnetized non-reciprocal ferromagnetic strips 65, 66 in the reduced height waveguides 49, 51 of the bifurcated waveguide section 15 provide a differential and non-reciprocal phase shift in the power propagated through this waveguide section. The phase shift properties in this section of guide permits microwave power to be transmitted through the three port circulator as follows: Power introduced at port 1 of the circulator is divided as above described between the first and second waveguide portions of the hybrid coupler 13 such that the microwave power traveling toward the bifurcated section in the top most waveguide path 21 is ninety degrees advanced in phase with respect to the power propagated along the lower waveguide path 19. As the microwave power in these two waveguide paths propagate down the reduced height waveguides of the bifurcated waveguide section 15, the distributed ferromagnetic material, in the presence of a static magnetic field, causes relative phase shifting of power in the top guide compared to the bottom guide as it travels down the length of the waveguide section. The length of the bifurcated guide and the ferromagnetic strips within this guide are established such that power in each of the reduced height waveguides 49, 51 arrive at the guide's bifurcated output end 50 substantially in phase. Thus, the power delivered from this bifurcated output end to any load attached to Port 2 of the circulator is the combined power from both reduced height waveguides. On the other hand, power reflected into Port 2 and back into the bifurcated waveguide section will divide between the reduced height waveguides and each of these components of the reflected power will experience a similar relative but opposite phase shift (ninety degrees) as they travel back through the bifurcated section. Because of the nonreciprocal nature of the static magnetized sections, the top guide will be advanced, compared to the bottom bifurcated guide. Thus this relative phase shift will cause the reflected power to arrive at the coupler output 19 with the top guide advanced ninety degrees ahead of the bottom. These out-of-phase components of the reflected power will cross couple between the upper and lower waveguide paths of the waveguide coupler causing the reflected power in the upper waveguide path 21 to add as it is delivered to port 3, while the reflected power in the lower waveguide path 19 cancels such that no reflected power reaches port 1 and the microwave source attached to this port. These adding and canceling properties are caused by the phase shifting of the reflected power as it is divided between the upper and lower microwave paths 19, 21. Thus, the reflected microwave power can be absorbed by a well matched termination or load attached to port 3 of the circulator.

It shall also be understood that any amount of power reflected from (or fed into) port 3 of the circulator will be directed to port 1, however, this power will be greatly attenuated if a matched termination is used at port 3. Circulation of power from port 3 to port 1 occurs because the power introduced at port 3 arrives at the bifurcated output end 50 of the bifurcated waveguide 180 degrees out-of-phase instead of in phase. Consequently, this power is reflected back to the waveguide coupler where, due to the phase relationships of the power in the upper and lower waveguide paths 21, 19, the reflected power is directed to port 1 rather than port 3. Thus, in accordance with the principle of the circulator power introduced to port 1 of the circulator arrives at port 2, power introduced to port 2 arrives at port 3, power introduced at port 3 arrives at port 1, and so on.

One of the benefits of the distributed ferromagnetic material used in the circulator's bifurcated waveguide section 15 is that the ferromagnetic strips, which generate considerable heat in high-power applications, are more easily cooled than in conventional junction circulator designs. This is because the strips present a much greater contact area for essentially the same power absorption. Referring to FIGS. 2 and 5, a water cooling circuit for the ferromagnetic material is provided in the form of lower and upper water cooling tubes 91, 93, running, respectively, along the upper and lower broadwalls 43*a*, 43*b* of the bifurcated waveguide 41 between the elongated magnetic pole plate pairs 79, 81. Each of the cooling tubes 91, 93 have a rectangular shape to maximize the contact surface area between the cooling tubes and the broadwalls of the guide. The upper and lower tubes are connected in a circuit by a connecting tube 95 at the end of the bifurcated waveguide behind waveguide flange 39. A suitable water input connector 97 and water outlet connector 99 are provided at the ends of the tubes behind flange 37.

It is noted that the length of the bifurcated waveguide section required to achieve sufficient phase shift of the microwave power from one end of the guide to the other can be shortened by increasing the thickness of the ferromagnetic strips. On the other hand, an increase in the thickness of the ferromagnetic strips will increase the resistance to heat flow through the ferromagnetic material. By keeping the ferromagnetic strips relatively thin in a longer bifurcated waveguide section, the circulator can generally be used in higher-power applications.

An S band distributed three port microwave circulator as illustrated in FIGS. 1, 2, 2A, 4 and 5 has been built and operated successfully with a bifurcated waveguide section having a 9-inch long section of WR284 waveguide with nickel ferrite strips positioned as shown in FIG. 5 having a length of 8.3 inches (including the tapers), a width of one inch, and a thickness of 0.9 inches.

Referring to FIG. 3, an alternative embodiment of the invention is shown for providing a transformation from a full height waveguide at the input end 12 of the waveguide coupler 11*a* to the reduced (approximately ½ height) stack waveguides 49, 51 of the bifurcated waveguide section 15. In this embodiment, the separate transformer section 17 of the embodiment shown in FIGS. 1 and 2 is eliminated. The transformer is rather integrated into the coupler section 13*a* by tapering the inner conductive walls 101, 103 of the coupler's outer broadwalls 105, 107. This provides a tapered transition between the coupler input end 12 and the coupler output 18*a*, resulting in improved bandwidth than is achieved with the stepped transformer shown in FIG. 2.

It will be appreciated that a number of variations of the preferred embodiments described and illustrated herein are possible within the scope of the invention. For example, while it is generally desirable to have ports 1, 2, and 3 of the microwave circulator of the same waveguide size, the invention contemplates the possibility that the guide sizes at these ports will not all be the same. In particular, it is contemplated that the circulator could be provided with a bifurcated waveguide section having stacked waveguides which are not reduced height waveguides, but which are full height guides. In such an embodiment there would be no requirement for a stepped or tapered transformer between the coupler section of the circulator and the bifurcated waveguide section. In such a design, the two stacked upper and lower waveguides of the bifurcated waveguide section would exit as full height waveguides, instead of reduced height waveguides. This would require a transformer at the bifurcated output end of the bifurcated waveguide or some other waveguide circuit configuration for coupling the output of the circulator into a microwave load. Such embodiments may suffer from disadvantages as exciting unwanted waveguide modes at the output of the circulator.

It is also contemplated that the non-reciprocal ferromagnetic material loading the reduced height waveguides of the bifurcated waveguide section 15 in the illustrated embodiments could be in the form of a distributed ferromagnetic materials other than elongated ferromagnetic strips. An example may be a series of short ferromagnetic pieces distributed along the length of the guide. However, again, such a construction generally would not be as suitable in high-powered applications.

Yet another contemplated embodiment of the invention would be to provide a bifurcated waveguide section in the form of separate stacked reduced height waveguides, as opposed to a single waveguide section bifurcated by a central web plate.

Still further, it would be possible to provide ferrite loading in only one of the stacked reduced-height waveguides of the bifurcated waveguide section as opposed to ferrite loading being provided in both reduced-height waveguides as described and illustrated herein. However, in such an embodiment, the length of the bifurcated waveguide section would have to be considerably longer to accomplish the desired relative phase shifting of the microwave power transmitted through each of the reduced-height waveguides.

Other possible embodiments for special applications might include the use of a waveguide coupler section 13 which is not a 3 db coupler but which divides the microwave power unequally, or the use of waveguides other than rectangular waveguides.

It is understood that yet further embodiments of the present invention would be possible within the scope and spirit of the invention, and that it is not intended that the scope of the invention be limited by the detailed descriptions herein, except as necessitated by the following claims.

What is claim is:

1. A distributed three port waveguide circulator comprising a.) a waveguide coupler section having two waveguide paths wherein microwave power inputted to one waveguide path is divided in an out-of-phase relation between said two waveguide paths, said waveguide coupler having a coupler output for said two waveguide paths, b.) a stacked rectangular waveguide section having broadwalls of a characteristic width and including i.) two stacked waveguide paths, said waveguide paths being stacked along the broadwalls of the stacked rectangular waveguide section, ii.) an input end coupled to the coupler output of said waveguide coupler section for coupling out-of-phase microwave power from said coupler output to the waveguide paths of said stacked waveguide section, iii.) a stacked output end through which microwave power combined from the two waveguide paths of said stacked waveguide section is delivered to a microwave load, said output end being stacked along the broadwalls of the stacked rectangular waveguide section, and iv.) at least one of the waveguide paths of said stacked waveguide section being loaded with a non-reciprocal ferromagnetic material distributed lengthwise along at least a portion of the length thereof, said ferromagnetic material, when magnetized in the presence of a transverse static magnetic field, acting to produce non reciprocal phase shift in the microwave power traveling along one of the waveguide paths of said stacked waveguide section relative to microwave power traveling through the other waveguide path thereof, and c.) a static magnetic circuit associated with said stacked waveguide section for magnetizing the distributed ferromagnetic material in the waveguide path thereof in the presence of a constant transverse static magnetic field, the distributed ferromagnetic material in said stacked waveguide section extending a sufficient length to permit relative phase shifting of the out-of-phase microwave power received from the coupler output of said waveguide coupler section to arrive substantially in phase at the stacked output end of said stacked waveguide section, and to permit power introduced into said stacked waveguide section at the output end thereof to arrive at the coupler output of said waveguide coupler section oppositely out-of-phase in relation to the power received from the coupler output, and d.) three ports for connecting a microwave power source and loads to the distributed three port waveguide circulator, two of said ports being associated with said waveguide coupler section, and one of said ports associated with the stacked output end of said stacked waveguide section.

2. The distributed three port waveguide circulator of claim 1 wherein said stacked waveguide section is formed of a bifurcated section of waveguide.

3. The distributed three port waveguide circulator of claim 1 wherein the waveguide paths of said waveguide coupler section are full height waveguides and the stacked waveguide paths of said stacked waveguide section are reduced height waveguides, and further wherein the waveguide circulator includes a transformer section for transforming the full height waveguides of said waveguide coupler section to the reduced height waveguides of said stacked waveguide section.

4. The distributed three port waveguide circulator of claim 3 wherein the reduced height waveguides of said stacked waveguide section are approximately one-half height waveguides.

5. The distributed three port waveguide circulator of claim 3 wherein said transformer portion includes a step transformer section connected between said coupler section and stacked waveguide section.

6. The distributed three port waveguide circulator of claim 1 wherein both of the waveguide paths of said stacked waveguide section are loaded with a non-reciprocal ferromagnetic material distributed along at least a portion of the length thereof.

7. The distributed three port waveguide circulator of claim 1 wherein the distributed ferromagnetic material loading at least one waveguide path of said stacked waveguide section is in the form of at least one ferromagnetic strip extending longitudinally along said waveguide path.

8. The distributed three port waveguide circulator of claim 7 wherein each of the stacked waveguide paths of said stacked waveguide section has an outer broadwall with an inner conductive surface, and said longitudinally extending ferromagnetic strip is secured to the inner conductive surface of said outer broadwall.

9. A distributed three port waveguide circulator comprising a.) a waveguide coupler section having two full height rectangular waveguide paths wherein microwave power inputted to one waveguide path is divided in an out-of-phase relation between said two waveguide paths, said waveguide coupler having a coupler output for said two waveguide paths, b.) a bifurcated full height rectangular waveguide section including i.) sidewalls and outer broadwalls having inner conductive surfaces, ii.) a longitudinally extending center web plate parallel to the broadwalls of said bifurcated waveguide section, said center web plate bifurcating said bifurcated waveguide section into two reduced height waveguide paths, iii.) an input end for coupling out-of-phase microwave power from said coupler output to the reduced height waveguide paths of said bifurcated waveguide section, iv.) a bifurcated output end through which microwave power combined from the two waveguide paths of said bifurcated waveguide section is delivered to a microwave load, and v.) each of the waveguide paths of said bifurcated waveguide section being loaded with a non-reciprocal ferromagnetic material distributed lengthwise along at least a portion of the length thereof, said ferromagnetic material, when magnetized in the presence of a transverse static magnetic field, acting to produce non reciprocal phase shift in the microwave power traveling along one of the waveguide paths of said bifurcated waveguide section relative to microwave power traveling through the other of said waveguide paths, c.) a transformer section for transforming the full height waveguides of said waveguide coupler section to the reduced height waveguides of said bifurcated waveguide section, d.) a magnetic circuit associated with said bifurcated waveguide section for magnetizing the distributed ferromagnetic material in the waveguide paths thereof in the presence of a constant transverse static magnetic field, the distributed ferromagnetic material in said bifurcated waveguide section extending a sufficient length to permit relative non reciprocal phase shifting of the out-of-phase microwave power received from said waveguide coupler section to arrive substantially in phase at the bifurcated output end of said bifurcated waveguide section, and to permit power introduced into said bifurcated waveguide section at the bifurcated output end thereof to arrive at the coupler output of the waveguide coupler oppositely section out-of-phase in relation to the power received from the coupler output, and e.) three ports for connecting a microwave power source and loads to the distributed three port waveguide circulator, two of said ports being associated with said waveguide coupler section, and one of said ports associated with the bifurcated output end of said bifurcated waveguide section.

10. The distributed three port waveguide circulator of claim 9 wherein the distributed ferromagnetic material loading each of the reduced height waveguide paths of said bifurcated waveguide section includes at least one longitudinally extending ferromagnetic strip secured to the inside conductive surface of the outer broadwall of said bifurcated waveguide section.

11. The distributed three port waveguide circulator of claim 10 wherein said ferromagnetic strips have tapered ends facing the input and output ends of said bifurcated waveguide section.

12. The distributed three port waveguide circulator of claim 9 wherein said bifurcated waveguide has a vertical plane of symmetry and the distributed ferromagnetic material loading each of the reduced height waveguide paths thereof extends longitudinally along and to each side of said vertical plane.

13. A distributed three port waveguide circulator comprising a.) a waveguide coupler section comprised of a first waveguide portion having defined terminals A and B, a second waveguide portion having defined terminals C and D, and an apertured common wall portion for dividing power introduced into any one of said terminals A, B, C, or D between said first and second waveguide portions, said apertured common wall portion further acting to cause a relative phase shift in the power coupled from one to the other of the waveguide portions of said waveguide coupler section, the first and second waveguide portions of said waveguide coupler section having a defined waveguide shape and size, and terminals B and C of said waveguide coupler section forming a coupler output, b.) a bifurcated waveguide section comprised of a section of waveguide corresponding in cross-sectional shape and size to the first and second waveguide portions of said waveguide coupler section, said section of waveguide being bifurcated into stacked reduced height waveguides having a bifurcated input end through which microwave power travels from and to the coupler output of said waveguide coupler section and a bifurcated output end, at least one of said reduced height waveguides being loaded with a non-reciprocal ferromagnetic material distributed along at least a portion of the length thereof, said ferromagnetic material, when magnetized in the presence of a transverse static magnetic field, acting to produce non reciprocal phase shift in the microwave power traveling through one of said reduced height waveguides relative to microwave power traveling through the other of said reduced height waveguides, c.) a transformer portion for coupling terminal B of the coupler output of said waveguide coupler section to one of the reduced height waveguides of said bifurcated waveguide section and for coupling terminal C of said coupler output to the other of the reduced height waveguides of said bifurcated waveguide section, d.) a static magnetic circuit associated with said bifurcated waveguide section for magnetizing the distributed ferromagnetic material in said reduced height waveguide in the presence of a static transverse magnetic field, the distributed ferromagnetic material in said bifurcated waveguide section extending a sufficient length to permit non reciprocal relative phase shifting of the out-of-phase microwave power received by the bifurcated input end of said bifurcated waveguide section from terminals B and C of the waveguide coupler section to arrive substantially in phase at the bifurcated output end of said bifurcated waveguide section, and to permit power introduced into said bifurcated waveguide section at the bifurcated output end thereof to arrive at the coupler output of said waveguide coupler section oppositely out-of-phase in relation to the power received from the coupler output, and e.) three ports for connecting a microwave power source and loads to the distributed waveguide circulator, one of said ports being associated with terminal A of said waveguide coupler section, one of said ports being associated with terminal D of said waveguide coupler section, and one of said ports associated with the bifurcated output end of said bifurcated waveguide section.

14. The distributed three port waveguide circulator of claim 13 wherein the waveguide portions of said waveguide coupler section are rectangular waveguides having a defined full height, and each of the stacked waveguides of said bifurcated waveguide section are approximately half height waveguides as compared to the full height of the waveguide portions of said waveguide coupler section.

15. The distributed three port waveguide circulator of claim 13 wherein said waveguide coupler section is a 3 db (hybrid) waveguide coupler.

16. The distributed three port waveguide circulator of claim 15 wherein said waveguide coupler section is a topwall hybrid waveguide coupler.

17. The distributed three port waveguide circulator of claim 13 wherein at least a portion of both of the reduced height waveguides of said bifurcated waveguide section are loaded with a lengthwise distributed non-reciprocal ferromagnetic material, and said static magnetic circuit produces oppositely directed transverse magnetic fields in the ferrite loaded portions of the reduced height waveguides of said bifurcated waveguide section whereby the ferromagnetic material of said reduced height waveguides, when magnetized in the presence of said oppositely directed, transverse magnetic fields, produce relative non reciprocal phase shift in the microwave power traveling through each said reduced height waveguide.

18. The distributed three port waveguide circulator of claim 13 wherein said transformer section is a step transformer.

19. The distributed three port waveguide circulator of claim 13 wherein said transformer section is a tapered wall transformer.

20. The distributed three port waveguide circulator of claim 19 wherein said tapered wall transformer is integral with the waveguide portions of said waveguide coupler section.

21. The distributed three port waveguide circulator of claim 13 wherein the distributed ferromagnetic material loading at least one reduced height waveguide of said bifurcated waveguide section is in the form of at least one longitudinally extending ferromagnetic strip positioned within said reduced height waveguide.

22. The distributed three port waveguide circulator of claim 21 wherein each of the stacked reduced height waveguides of said bifurcated waveguide section is a rectangular waveguide having an outer broadwall with an interior conductor surface, and said longitudinally extending ferromagnetic strip is secured to the interior conductor surface of said outer broadwall.

23. The distributed three port waveguide circulator of claim 22 wherein the outer broadwall of said reduced height waveguides have a vertical plane of symmetry and wherein at least two ferromagnetic strips longitudinally extend in parallel relation along the outer broadwall of at least one of said reduced height waveguides on either side of the vertical plane thereof.

24. The distributed three port waveguide circulator of claim 13 wherein the stacked reduced height waveguides of said bifurcated waveguide section are rectangular waveguides separated by a common web plate fabricated of a magnetic material, said web plate forming an inner broadwall of said rectangular reduced height waveguides, each said rectangular reduced height waveguide has an outer broadwall with an interior conductor surface opposed to said web plate, the distributed ferromagnetic material which loads the at least one reduced height waveguide is in the form of at least one longitudinally extending ferromagnetic strip secured to the interior conductor surface of the outer broadwall of said at least one reduced height waveguide, and said static magnet circuit includes said common web plate and at least one exterior magnet positioned on the outside of said outer broadwall for producing a transverse magnetic field through said ferromagnetic strip.

25. The distributed three port waveguide circulator of claim 24 wherein said exterior magnets are permanent magnets.

26. The distributed three port waveguide circulator of claim 24 wherein the web plate separating the stacked waveguides of said bifurcated waveguide section is plated with a conductive material.

27. The distributed three port waveguide circulator of claim 26 wherein said web plate is fabricated of magnetic steel.

28. The distributed three port waveguide circulator of claim 27 wherein said web plate is plated with copper.

29. The distributed three port waveguide circulator of claim 27 wherein said web plate is plated with silver.

30. A bifurcated waveguide section for a distributed three port waveguide circulator which includes a waveguide coupler section having two waveguide paths and a coupler output wherein microwave power inputted to one waveguide path of the waveguide coupler section is divided in an out-of-phase relation between said two waveguide paths, said bifurcated waveguide section comprising a) a section of rectangular waveguide defined by sidewalls and outer broadwalls having inside conductive surfaces, b) a longitudinally extending center web plate parallel to the broadwalls of said bifurcated waveguide section, said center web plate bifurcating said waveguide section into a bifurcated waveguide section having two reduced height waveguide paths, c) an input end through which out-of-phase microwave power travels between the two waveguide paths of said waveguide coupler section and said bifurcated waveguide section, d) a bifurcated output end through which microwave power combined from the two waveguide paths of said bifurcated waveguide section is delivered to a microwave load, and e) each of the waveguide paths of said bifurcated waveguide section being loaded with a non-reciprocal ferromagnetic material distributed along at least a portion of the length thereof, said ferromagnetic material, when properly magnetized in the presence of a static transverse magnetic field, acting to produce non-reciprocal phase shift in the microwave power traveling along one of the waveguide paths of said bifurcated waveguide section relative to microwave power traveling through the other of said waveguide paths.

31. The bifurcated waveguide section of claim 30 wherein the distributed ferromagnetic material loading each of said reduced height waveguide paths is secured against the inner conductive surfaces of outer broadwalls of the bifurcated waveguide section.

32. The bifurcated waveguide section of claim 31 wherein cooling tubes for carrying a flow of coolant extend along the outside of the broadwalls of the bifurcated waveguide section for cooling the ferromagnetic material on the inside conductive surface of said broadwalls.

33. The bifurcated waveguide section of claim 30 wherein said bifurcated waveguide has a vertical plane of symmetry and the distributed ferromagnetic material loading each of the reduced height waveguide paths thereof extends longitudinally along and to each side of said vertical plane.

34. The bifurcated waveguide section of claim 30 wherein the distributed ferromagnetic material loading each of the reduced height waveguide paths of said bifurcated waveguide section includes at least one longitudinally extending ferromagnetic strip secured to the inside conductive surface of the outer broadwall of said bifurcated waveguide section.

35. The bifurcated waveguide section of claim 34 wherein said ferromagnetic strips have tapered ends facing the input and output ends of said bifurcated waveguide section.

* * * * *